US008213629B2

(12) United States Patent
Goldstein et al.

(10) Patent No.: US 8,213,629 B2
(45) Date of Patent: Jul. 3, 2012

(54) METHOD AND SYSTEM FOR AUTOMATIC LEVEL REDUCTION

(75) Inventors: Steven Goldstein, Delray Beach, FL (US); John Usher, Montreal (CA); Marc Boillot, Plantation, FL (US)

(73) Assignee: Personics Holdings Inc., Boca Raton, FL (US)

( * ) Notice: Subject to any disclaimer, the term of this patent is extended or adjusted under 35 U.S.C. 154(b) by 653 days.

(21) Appl. No.: 12/394,604

(22) Filed: Feb. 27, 2009

(65) Prior Publication Data

US 2009/0290721 A1 Nov. 26, 2009

Related U.S. Application Data

(60) Provisional application No. 61/032,730, filed on Feb. 29, 2008.

(51) Int. Cl.
*H04R 1/10* (2006.01)

(52) U.S. Cl. ..... 381/74; 381/107; 381/108

(58) Field of Classification Search ..... 381/74, 381/56, 72, 104, 107, 108
See application file for complete search history.

(56) References Cited

U.S. PATENT DOCUMENTS

| | | | | |
|---|---|---|---|---|
| 5,046,101 | A | 9/1991 | Lovejoy | |
| 5,204,971 | A | 4/1993 | Takahashi et al. | |
| 6,868,162 | B1 | 3/2005 | Jubien et al. | |
| 7,302,062 | B2 | 11/2007 | Christoph | |
| 2008/0137873 | A1 * | 6/2008 | Goldstein | 381/57 |
| 2009/0240497 | A1 * | 9/2009 | Usher et al. | 704/235 |

OTHER PUBLICATIONS

U.S. Appl. No. 11/942,370, filed Nov. 19, 2007, 39 pgs.
U.S. Appl. No. 11/966,457, filed Dec. 28, 2007, 40 pgs.
U.S. Appl. No. 12/022,826, filed Jan. 30, 2008, 60 pgs.
U.S. Appl. No. 12/035,873, filed Feb. 22, 2008, 67 pgs.

* cited by examiner

*Primary Examiner* — Kevin M Picardat
(74) *Attorney, Agent, or Firm* — RatnerPrestia

(57) ABSTRACT

A method to automatically adjust listening levels to safe listening levels is provided. The method can include the steps of monitoring an audio content level, monitoring a sound pressure level within an ear canal, and gradually reducing over time a volume of the audio content responsive to detecting intermittent manual volume increases of the audio content.

21 Claims, 5 Drawing Sheets

(a)

(b)

(c)

METHOD AND SYSTEM FOR AUTOMATIC LEVEL REDUCTION

CROSS REFERENCE TO RELATED APPLICATIONS

This application is a Non-Provisional Application of and claims the priority benefit of Provisional Application No. 61/032,730 filed on Feb. 29, 2008, the entire disclosure of which is incorporated herein by reference.

FIELD

The present invention relates to sound systems, and more particularly, though not exclusively, to a method and system for automatic level reduction using an earpiece.

BACKGROUND

While many headset users are aware that listening to music at high volumes can lead to hearing loss, not many of them—especially not teens—do anything about it. Interestingly, when teens are pressured by friends or family to turn down the volume on their music devices, it seems they turn up the volume up instead. Even teens who express concern about the risk of hearing loss listen to music at potentially dangerous levels—higher on average than teens who say they are not worried about deafness.

A need therefore exists for sound intervention and automatic level reduction in an effort to prevent hearing damage.

SUMMARY

In a first embodiment an earpiece can include an Ear Canal Receiver (ECR) to deliver audio content to an ear canal, and a processor operatively coupled to the ECR to reduce over time a level of the delivered audio content responsive to detecting intermittent manual increase gain adjustments by the wearer. The processor can reduce the level of the audio content over time as a function of time differences and level differences between the intermittent manual increase gain adjustments.

The earpiece can also include an Ear Canal Microphone (ECM) configured to measure a sound pressure level (SPL) within the ear canal. The processor in view of the SPL can adjust a gain decay envelope of the audio content to a safe listening level according to an SPL Dose chart. The SPL Dose chart can receive as input at least one of an inter-event time, an ambient sound level, or an audio content level, to map the input to a gain level reduction of the audio content.

The earpiece can further include an Ambient Sound Microphone (ASM) to capture ambient sound, and a sealing section to partially occlude the ear canal for suppressing ambient sound from entering the ear canal. The processor can regulate a pass-through of the ambient sound through the sealing section to the ear-canal by way of the ECR to increase perceived audio content loudness. The sealing section can be a foam ear insert, an inflatable balloon, or a bio-material.

In a second embodiment, a method to automatically adjust listening levels can include monitoring a level of audio content delivered to an Ear Canal Receiver (ECR), monitoring a sound pressure level within an ear-canal, due in part to ambient sound and the audio content, and modifying the audio content responsive to detecting intermittent manual increase gain adjustments of the audio content. The step of modifying the audio content can include reducing a gain of the audio content signal over time after a manual gain change is detected.

In one arrangement, the method can include identifying a first event time at which a first manual gain change is detected, identifying a second event time at which a second manual gain change is detected, calculating a time difference between the first and second event time to produce an inter-event time, and reducing the magnitude of the audio content as a function of the inter-event time, whereby smaller inter-event times produce smaller changes in the reduction of audio content gain. Further, a first level difference responsive to a first manual gain change can be identified, and a second level difference responsive to a second manual gain change can be identified. A level difference ratio can then be calculated between the first and second level difference for reducing the magnitude of the audio content as a function of the inter-event time and the level difference ratio.

The method can further include the step of detecting a sound pressure level (SPL) change in the ambient environment by way of an Ambient Sound Microphone (ASM), and adjusting a pass-through of the ambient sound through a sealing section of the earpiece to the ear-canal by way of the ECR to maintain a constant ratio of the audio content SPL and residual ambient sound SPL in the ear canal. The pass-through of the ambient sound to the ear-canal can be reduced responsive to detecting the manual increase gain adjustment so as to perceptually enhance the audio content loudness relative to the ambient sound.

In one arrangement, a residual ambient sound level in the ear canal can be estimated by compensating the ambient sound level for a noise reduction rating of the earpiece. In another arrangement, an SPL of the audio content can be estimated within the ear canal by applying an Ear Canal Transfer Function (ECTF) to the audio content signal delivered to the ECR. The residual ambient sound level in the ear canal in this arrangement can be estimated by subtracting the estimated SPL of the audio content from the measured SPL within the ear-canal. A first slow weighted average of a SPL measured within the ear canal and a second slow weighted average of an ambient sound SPL can be applied to produce a gain decay envelope with which to modify the audio content.

In a third embodiment, a method for perceptual reduction of audio content volume suitable for use in a mobile device or earpiece can include the steps of monitoring a music listening level within an ear canal, reporting if the music listening level is within or exceeds a safe listening level, monitoring volume gain increases by a user of the mobile device or earpiece, and gradually reducing the volume of the audio content over time responsive to intermittent volume gain increases so as to minimize a change in perceptual loudness associated with the gradual reduction in volume. The volume can be reduced in increments of a Just Noticeable Difference (JND) as a function of time differences between the intermittent volume gain increases and level differences of the intermittent volume gain increases. The method can include estimating a first gain difference associated with a first user gain increase, identifying a time difference between the first user gain increase and a second user gain increase, estimating a second gain difference associated with the second user gain increase, and reducing the volume of the audio content as a function of the time difference and ratio of the first gain difference to second gain difference.

DETAILED DESCRIPTION

Figure 1:
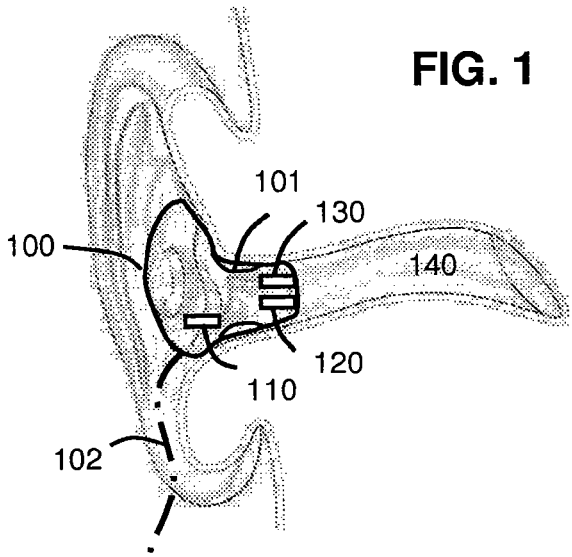
FIG. 1 is a pictorial diagram of an earpiece in accordance with an exemplary embodiment.

The following description of at least one exemplary embodiment is merely illustrative in nature and is in no way intended to limit the invention, its application, or uses. Similar reference numerals and letters refer to similar items in the following figures, and thus once an item is defined in one figure, it may not be discussed for following figures.

At least one exemplary embodiment of the invention is directed to an earpiece that groups common event information from multiple text messages from different sources and generates an audio token that collectively identifies and audibly delivers the event information to a user of the earpiece. This reduces the number of audible messages that the user must listen too since each audible token is collectively related to the same event. For instance, event invitations to a same event celebration at a same location can be grouped and collectively sent as a single audio token. Thus, instead of the user listening to every text message from invitees the user can hear a collective audio token identifying all the participants attending the event and respond singly to the group.

Reference is made to FIG. 1 in which an earpiece device, generally indicated as earpiece 100, is constructed in accordance with at least one exemplary embodiment of the invention. Earpiece 100 includes an Ambient Sound Microphone (ASM) 110 to capture ambient sound, an Ear Canal Receiver (ECR) 120 to deliver audio to an ear canal 140, and an ear canal microphone (ECM) 130 to assess a sound exposure level within the ear canal. Audio content can be delivered via a wired connection 102 or via wireless communications. The earpiece 100 can partially or fully occlude the ear canal 140 by way of the sealing material 101 to provide various degrees of acoustic isolation.

The earpiece 100 can actively monitor a sound pressure level both inside and outside an ear canal and enhance spatial and timbral sound quality to ensure safe reproduction levels. The earpiece 100 in various embodiments can provide listening tests, filter sounds in the environment, monitor warning sounds in the environment, present notices based on identified warning sounds, adjust audio content levels with respect to ambient sound levels, and filter sound in accordance with a Personalized Hearing Level (PHL). The earpiece 100 is suitable for use with users having healthy or abnormal auditory functioning. The earpiece 100 can be an in the ear earpiece, behind the ear earpiece, receiver in the ear, open-fit device, or any other suitable earpiece type. Accordingly, the earpiece 100 can be partially or fully occluded in the ear canal.

Figure 2:
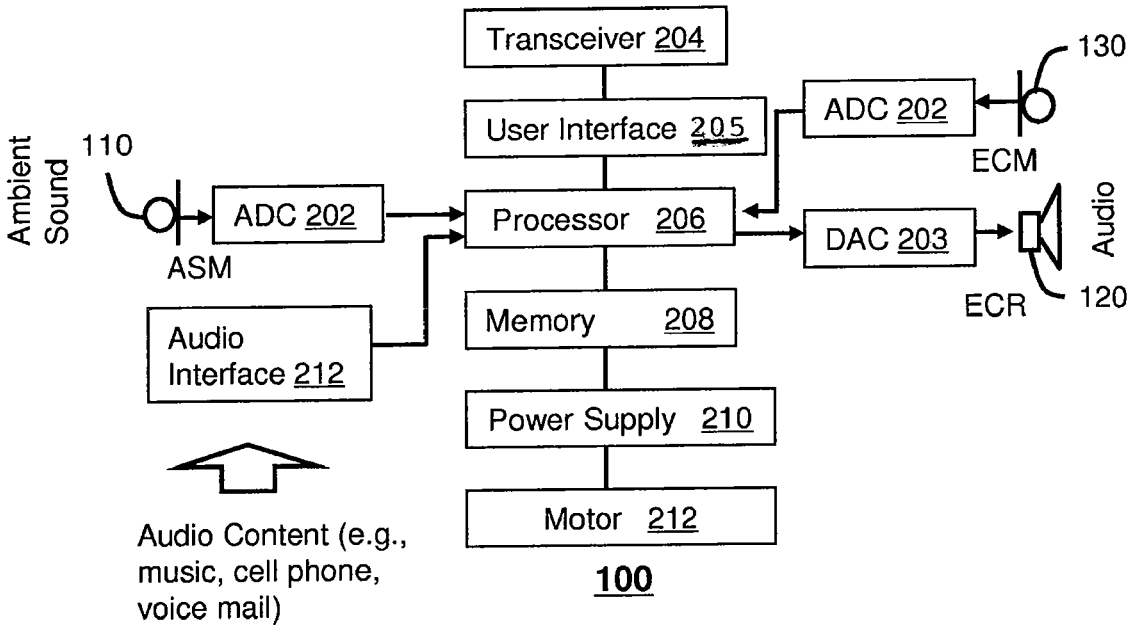
FIG. 2 is a block diagram of the earpiece in accordance with an exemplary embodiment.

Referring to FIG. 2, a block diagram of the earpiece 100 in accordance with an exemplary embodiment is shown. As illustrated, the earpiece 100 can further include a processor 206 operatively coupled to the ASM 110, ECR 120 and ECM 130 via one or more Analog to Digital Converters (ADC) 202 and Digital to Analog Converters (DAC) 203. The processor 206 can produce audio from at least in part the ambient sound captured by the ASM 110, and actively monitor the sound exposure level inside the ear canal 140. The processor 206 responsive to monitoring the sound exposure level can adjust the audio in the ear canal 140 to within a safe and subjectively optimized listening level range. The processor 206 can utilize computing technologies such as a microprocessor, Application Specific Integrated Chip (ASIC), and/or digital signal processor (DSP) with associated storage memory 208 such a Flash, ROM, RAM, SRAM, DRAM or other like technologies for controlling operations of the earpiece device 100.

The earpiece 100 can further include a transceiver 204 that can support singly or in combination any number of wireless access technologies including without limitation Bluetooth™, Wireless Fidelity (WiFi), Worldwide Interoperability for Microwave Access (WiMAX), and/or other short or long range communication protocols. The transceiver 204 can also provide support for dynamic downloading over-the-air to the earpiece 100. It should be noted also that next generation access technologies can also be applied to the present disclosure.

The earpiece 100 can also include an audio interface 212 operatively coupled to the processor 206 to receive audio content, for example from a media player, and deliver the audio content to the processor 206. The processor 206 responsive to detecting an incoming call or an audio message can adjust the audio content and the warning sounds delivered to the ear canal. The processor 206 can actively monitor the sound exposure level inside the ear canal and adjust the audio to within a safe and subjectively optimized listening level range. The earpiece 100 can further include user interface 205 coupled to processer 206. The processor 206 can utilize computing technologies such as a microprocessor, Application Specific Integrated Chip (ASIC), and/or digital signal processor (DSP) with associated storage memory 208 such a Flash, ROM, RAM, SRAM, DRAM or other like technologies for controlling operations of the earpiece device 100.

The power supply 210 can utilize common power management technologies such as replaceable batteries, supply regulation technologies, and charging system technologies for supplying energy to the components of the earpiece 100 and to facilitate portable applications. The motor 212 can be a single supply motor driver coupled to the power supply 210 to improve sensory input via haptic vibration. As an example, the processor 206 can direct the motor 212 to vibrate responsive to an action, such as a detection of an incoming voice call.

The earpiece 100 can further represent a single operational device or a family of devices configured in a master-slave arrangement, for example, a mobile device and an earpiece. In the latter embodiment, the components of the earpiece 100 can be reused in different form factors for the master and slave devices.

Figure 3:
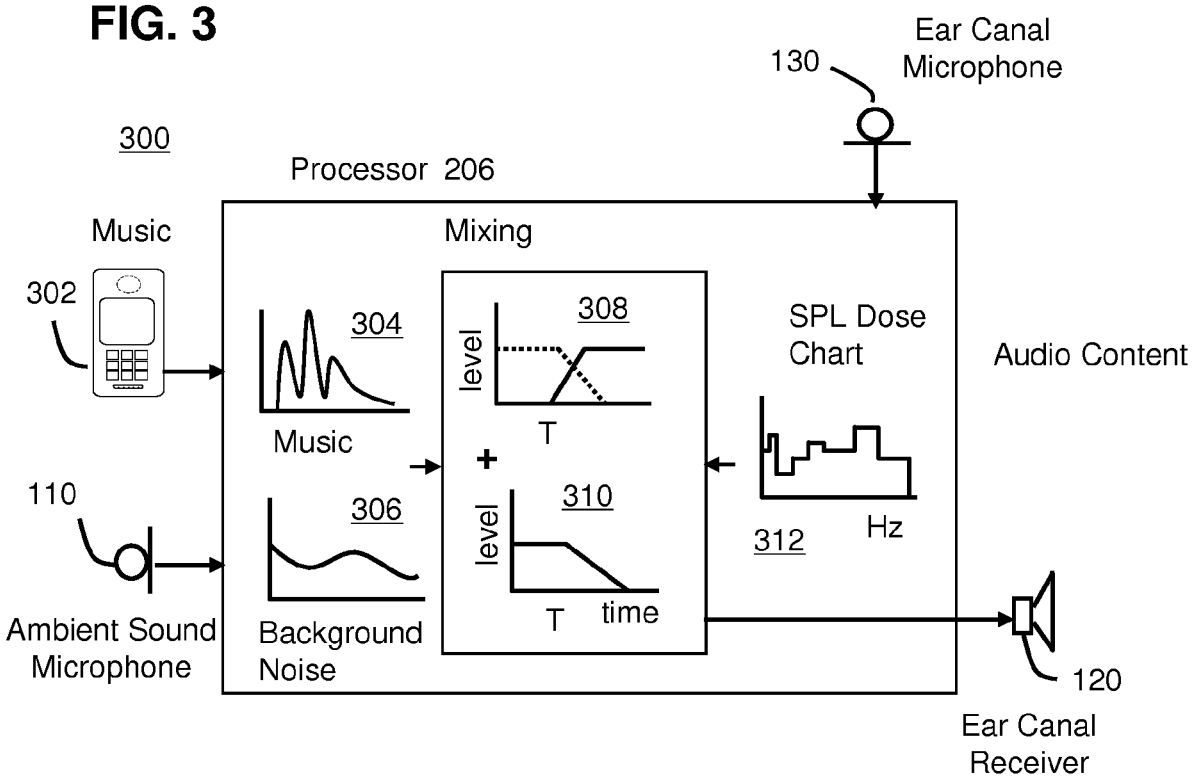
FIG. 3 is a pictorial diagram illustrating a mixed signal output in accordance with an exemplary embodiment.

FIG. 3 is a pictorial diagram 300 illustrating a mixed signal output in accordance with an exemplary embodiment of the earpiece 100 of FIG. 1. In general, an audio content signal from an external source such as mobile device 302 (e.g., music player, cell phone, etc.) can be delivered to the ECR 120 for listening by the wearer of the earpiece. Responsive to manual volume gain increases, the processor 206 can over time gradually reduce the audio content level delivered to the ECR to safe listening levels if the audio content approaches or exceeds an unsafe listening level. In one arrangement, the audio content signal can be mixed with ambient sound microphone 110 to elevate perceived loudness responsive to an increased volume request by the user. The ECM 130 can monitor changes in SPL and perceived loudness during the automatic reduction. More than one external sound source can be provided such as a multimedia player, computer, radio, and television to name but a few. The mixing of different signals can be varied depending on the situation in which the device is used.

As illustrated, the processor 206 delivers audio content from the mobile device 302 to the ear canal by way of the ECR 120. The processor 206 is operatively coupled to the ECR 120 to reduce over time a level of the audio content (e.g., music) delivered to the ECR 120 responsive to detecting intermittent manual increase gain adjustments by a user of the earpiece; for instance, when the user occasionally adjusts the volume settings of the mobile device 302 to drastically increase the music level to the earpiece 100. Alternatively, the user may interact with buttons on the earpiece directly to adjust the volume.

To prevent the user from continuously listening to the audio content at unsafe or potentially damaging listening levels, the processor 206 automatically reduces over time the level of the audio content to safe listening levels. Aspects of safe listening level as related to SPL Dose monitoring are presented in U.S. patent application Ser. Nos. 11/942,370 and 12/022,826, the entire contents of which are hereby incorporated by reference. As will be explained ahead in more detail, it does so, in one embodiment, as a function of time differences between the i) intermittent manual increase gain adjustments and ii) level differences of the intermittent manual increase gain adjustments made by the user.

Briefly, the processor 206 can apply gain reductions envelopes 308 to the audio content signal 304 to produce a gain scaled audio content signal. The parameters of the envelope can be supplied by the SPL Dose Chart 312, which receives as input audio content level, user gain increase history, hearing profile, and ambient sound levels. The processor 206 can also apply gain reduction envelopes 310 to the background noise signals 306 captured from the ASM. The parameters of the envelope for the ASM signal depend on a user configuration setting (e.g., pass-through mode) and the SPL Dose Chart. The gain scaled audio content and gain scaled ambient sound can then be mixed (e.g., added, summed) together to produce the audio content signal that is delivered to the ECR 120. This audio content signal thus provides a degree of situational awareness since it contains the ASM signal and the audio content.

The Ear Canal Microphone (ECM) 130 is configured to measure a sound pressure level (SPL) within the ear canal thereby permitting the processor 206 to analyze listening levels in the ear canal as heard by the user for automatically reducing the audio content levels (or combined audio content and ASM signals). Since the processor 206 can further analyze the audio content levels prior to their delivery to the ECR 120, it can estimate an Ear Canal Transfer Function (ECTF). The ECTF can be used to assess the sealing level of the earpiece which partially occludes the ear canal. The processor 206 in view of the SPL and ECTF adjusts the gain decay envelope 308 of the audio content signal 304 to a safe listening level according to an SPL Dose chart 312.

The processor 206 can adjust the gain decay envelope 308 according to the frequency of occurrence and level difference of the intermittent manual increase gain adjustments so as to minimize the user's interaction with manually adjusting the volume. The processor 206 projects (or predicts) the longest perceptually acceptable time interval at which the gain 308 can be reduced to safe listening levels without annoying the user based on the user's interaction habits with the earpiece or mobile device (e.g., manually changing the volume). The SPL Dose chart 312 receives as input at least one of an inter-event time, an ambient sound level, or an audio content level, and maps the input to a gain level reduction (decay envelope) of the audio content.

As indicated, the Ambient Sound Microphone (ASM) 110 captures ambient sound 306 in the user's local environment. Ambient sound 306 can be background noises, traffic noise, wind noise, babble sounds, or other natural, industrial or man made sounds. Recall, the sealing section 101 (see FIG. 1) of the earpiece 100 partially occludes the ear canal and suppresses ambient sound from entering the ear canal. In general, the processor 206 regulates a pass-through of the ambient sound through the sealing section 101 to the ear-canal by way of the gain envelope 310. For example, the processor 206 by way of the gain envelope 310 can completely attenuate (e.g., 0% gain) the pass-through of ambient sounds from the ASM 110 to the ECR 120 and provide the full noise reduction rating (NRR) of the earpiece 100 due to the sealing section 101. Alternatively, the processor 206 can permit full pass-through (e.g., 100% gain) to permit the user to hear the ambient environment.

The sealing section 101 (FIG. 1) can be a foam ear insert, bio-material or an inflatable balloon as previously noted. For instance, if the sealing section 101 provides 30 dB NRR, then ambient sounds without pass-through enabled will be suppressed by 30 dB. Alternatively, the processor 206 can permit pass-through of the ambient sound thereby overcoming the NRR, and permit the user to hear ambient sounds in a transparent mode as though the earpiece 100 were absent. Further, the processor 206 can amplify the ambient sound to perform as a hearing enhancement device or hearing aid above the NRR.

In one exemplary embodiment, for instance as a first step in elevating perceived audio content loudness relative to a user manual gain increase, processor 206 reduces a level of the ambient sound microphone 110 while correspondingly increasing the level of the audio content to reduce pass-through. This gives the audible sensation of increasing the music level relative to the ambient sounds (e.g., background noise level); hence, elevating perceived audio content loudness. In general, audio content from communication device 302 or from other devices can be muted or decreased in level relative to the audio content levels to enhance perceptual audio content loudness as a first step to satisfying the user's need to turn up the volume.

The ramp up and down times of the gain envelope 308 for the audio content can also be adjusted based on the priority of the sound or earpiece configuration. For example, responsive to the earpiece detecting a warning sound (e.g., fire alarm, whistle, horn, etc.) by way of the ASM 110, a higher priority can be assigned for attacking the audio content level downward. A fast decay attack would be performed to permit the user to hear the warning sound in the environment over the music. Aspects of sound signature detection as related to priority of sound mixing is presented in U.S. patent application Ser. Nos. 11/966,457 and 12/035,873, the entire contents of which are hereby incorporated by reference. Furthermore, the processor 206 can spectrally enhance the audio content in view of the SPL Dose chart 312 before delivering the audio content to the ECR 120 for response. A timbral balance of the response can be maintained by taking into account level dependent equal loudness curves and other psychoacoustic criteria (e.g., masking).

Figure 4:
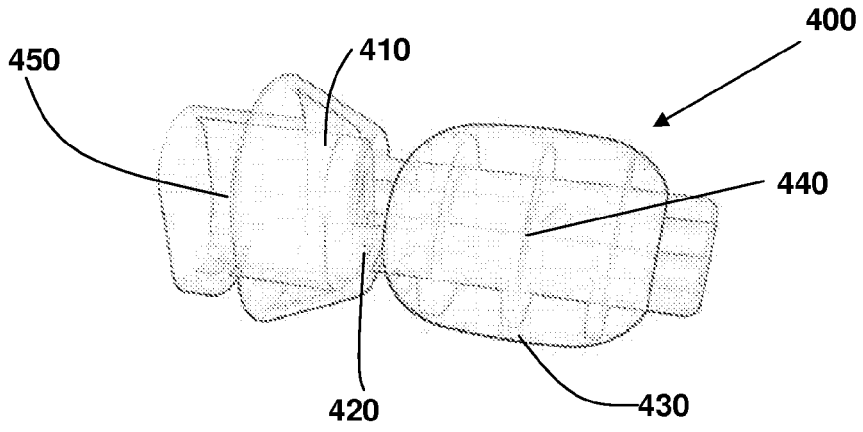
FIG. 4 is an inflatable system for sealing an ear canal in accordance with an exemplary embodiment.

FIG. 4 is an inflatable system 400 for sealing an ear canal in accordance with an exemplary embodiment. Referring to FIG. 1, the earpiece 100 can partially or fully occlude the ear canal 140. In at least one exemplary embodiment, inflatable system 400 is operably configured to earpiece 100 for occluding ear canal 140. Inflatable system 400 comprises an insertion element 420, an expandable element 430, a stop flange 410, and an instrument package 450.

Insertion element 420 is a multi-lumen tube having one or more acoustic channels for providing or receiving sound from the ear canal. Expandable element 430 overlies insertion element 420 for sealing the ear canal. Expandable element 430 can be an inflatable structure such as a balloon. The balloon can be filled with an expanding medium such as gas, liquid, electro active polymer, or gel that is fed through a supply tube 440. Supply tube 440 is a path for adding or reducing the medium from expandable element 430. The balloon can comprise an elastic or inelastic material. For example, expandable element 430 comprises urethane, nylon, or silicone. In general, expandable element 430 compresses or is deflated such that it readily fits into an ear canal opening. Inflating expandable element 430 seals the ear canal for attenuating sound from an ambient environment. Expandable element 430 conforms to the shape of the ear canal in a manner that is comfortable for extended periods of earpiece use and provides consistent attenuation from the ambient environment under varying user conditions.

Stop flange 410 limits how far the user of the earpiece can insert insertion element 420 and expandable element 430 into the ear canal. Limiting the range of insertion prevents scratching the ear canal or puncturing the tympanic membrane. In at least one exemplary embodiment, insertion element 420 comprises a flexible material that flexes should it come in contact with the ear canal thereby preventing damage to the ear canal wall. The instrument package 450 is an area of the earpiece for holding additional devices and equipment to support the expansion such as a power supply, leads, gas and/or fluid generation systems.

Figure 5:
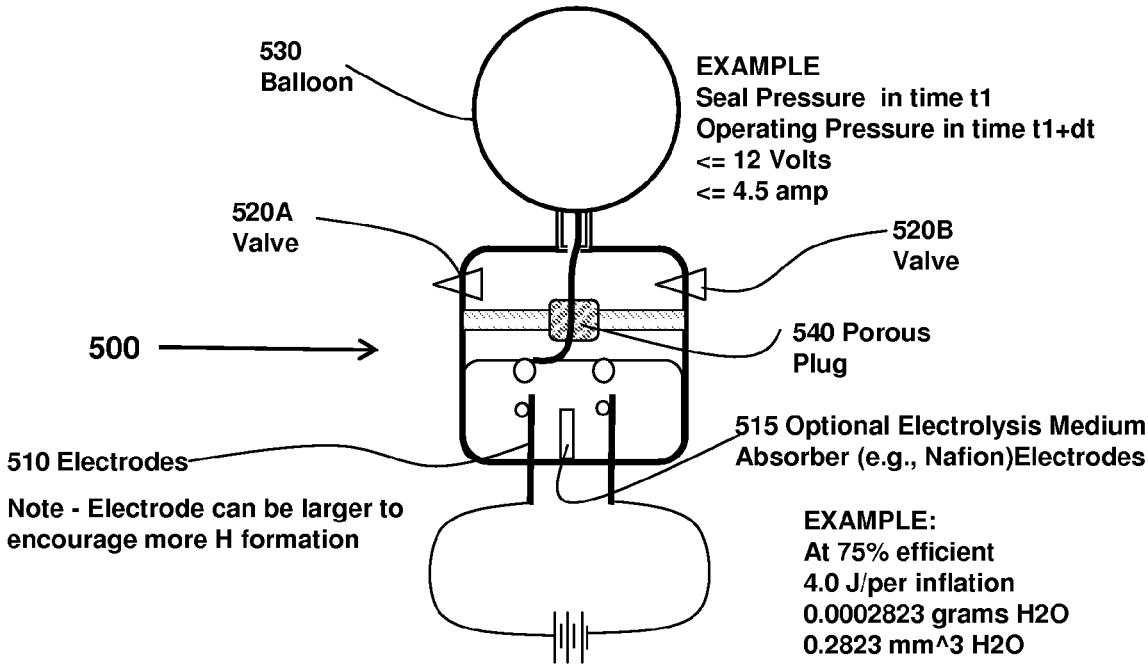
FIG. 5 is an illustration of an inflation device for an expandable element in accordance with an exemplary embodiment.

FIG. 5 is an illustration of an inflation device 500 for an expandable element in accordance with an exemplary embodiment. In the non-limiting example, inflation device 500 is a component of earpiece 100 that inflates a balloon 530 inserted in ear canal 140. Inflation device 500 comprises pressure valve 520A, pressure valve 520B, electrodes 510, a porous plug 540, and optionally a membrane 515.

In at least one exemplary embodiment, inflation device 500 includes a liquid such as $H_2O$ (water) with a salt such as NaCl dissolved therein. For example, NaCl dissolved at a concentration 0.001 mole/liter supports the electrolysis. Electrodes 510 are spaced from one another in the solution. The NaCl allows a current to pass between the electrodes 510 when a voltage is applied across electrodes 510. Electrodes 510 act as if they were essentially in free electrolysis material while at the same time preventing the electrodes from touching. Optional membrane 515 facilitates in reducing a distance between electrodes 510. Reducing the distance between electrodes 510 increases the electric field and hence the current. In at least one exemplary embodiment, membrane 515 is an electrolysis medium absorber such as Nafion.

The electrolysis system shown includes the porous plug 540 that is coupled to a chamber. Gas generated by electrolysis passes through porous plug 540 into a chamber having valves 520A and 520B. The control valves 520A and 520B allow a predetermined gauge pressure value to be reached inside of the chamber (e.g. 50% gauge). The chamber couples to balloon 530. Gas from outside the chamber enters into the chamber if the gauge pressure value drops below the predetermined gauge pressure value thereby regulating the pressure in balloon 530. The gauge pressure in this instance is calculated as the pressure inside the chamber minus the pressure outside the chamber.

Figure 6:
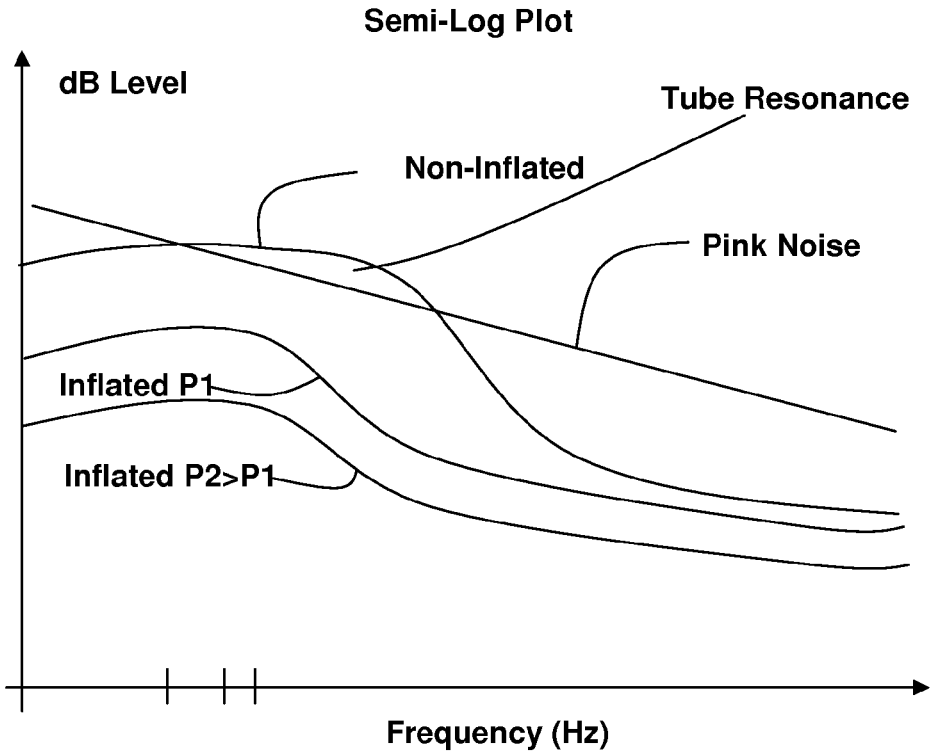
FIG. 6 is an illustration showing attenuation due to occlusion of a balloon in an ear canal at different pressure levels.

FIG. 6 is an illustration showing attenuation due to occlusion of balloon 530 in an ear canal at different pressure levels. Balloon 530 is placed in the cartilaginous region of ear canal 140. A gas or liquid inflating balloon 530 in ear canal 140 applies a pressure on the balloon material pressing the material against the walls of ear canal 140. It has been found that increasing the pressure in balloon 530 correspondingly increases the isolation or attenuation from the ambient environment. Thus, the active system illustrated in FIGS. 4 and 5 allow the attenuation to be varied by controlling the pressure in balloon 530. For example, in a speech to text conversion for responding to a text message the quality of the conversion would be more consistent by detecting the noise level in the ambient space and increasing the pressure of the sealing section (to increase attenuation/reduce background noise) while switching to the ear canal microphone to obtain the response for conversion.

In general, FIG. 6 illustrates sound isolation results (attenuation+reflection) as a function of inflation plotted in semi-log scale. In the example of an earpiece, the balloon isolates the ear canal from the ambient environment (outside the ear). The attenuation is achieved by providing pink noise in the ambient environment measured at an ambient side of the balloon and measuring the noise level in the ear canal. The difference in the noise levels is the attenuation provided by the balloon. The plot shows that the attenuation is frequency dependent. Note that the inflation can be varied to obtain a variation in attenuation. Thus, the curve related to pressure P2 has a greater attenuation across the frequency band than inflated pressure P1 where P2>P1.

The inflation can be either a liquid (e.g. water), a gas (e.g. $H_2O$ vapor, $H_2$, $O_2$ gas) or a combination of both. In accordance with at least one exemplary embodiment, the sound isolation level can be controlled by increasing the pressure of the inflatable system in the ear canal above a particular seal pressure value. The seal pressure value is the pressure at which the inflatable system has conformed to the inside of the orifice such that a drop between the sound pressure level on one side of the inflatable system Is different from the sound pressure level on the opposite side of the inflatable system by a drop value over a short period of time. For example, when a sudden (e.g. 1 second) drop (e.g. 3 dB) occurs by a particular pressure seal level (e.g. 2 bar).

Figure 7:
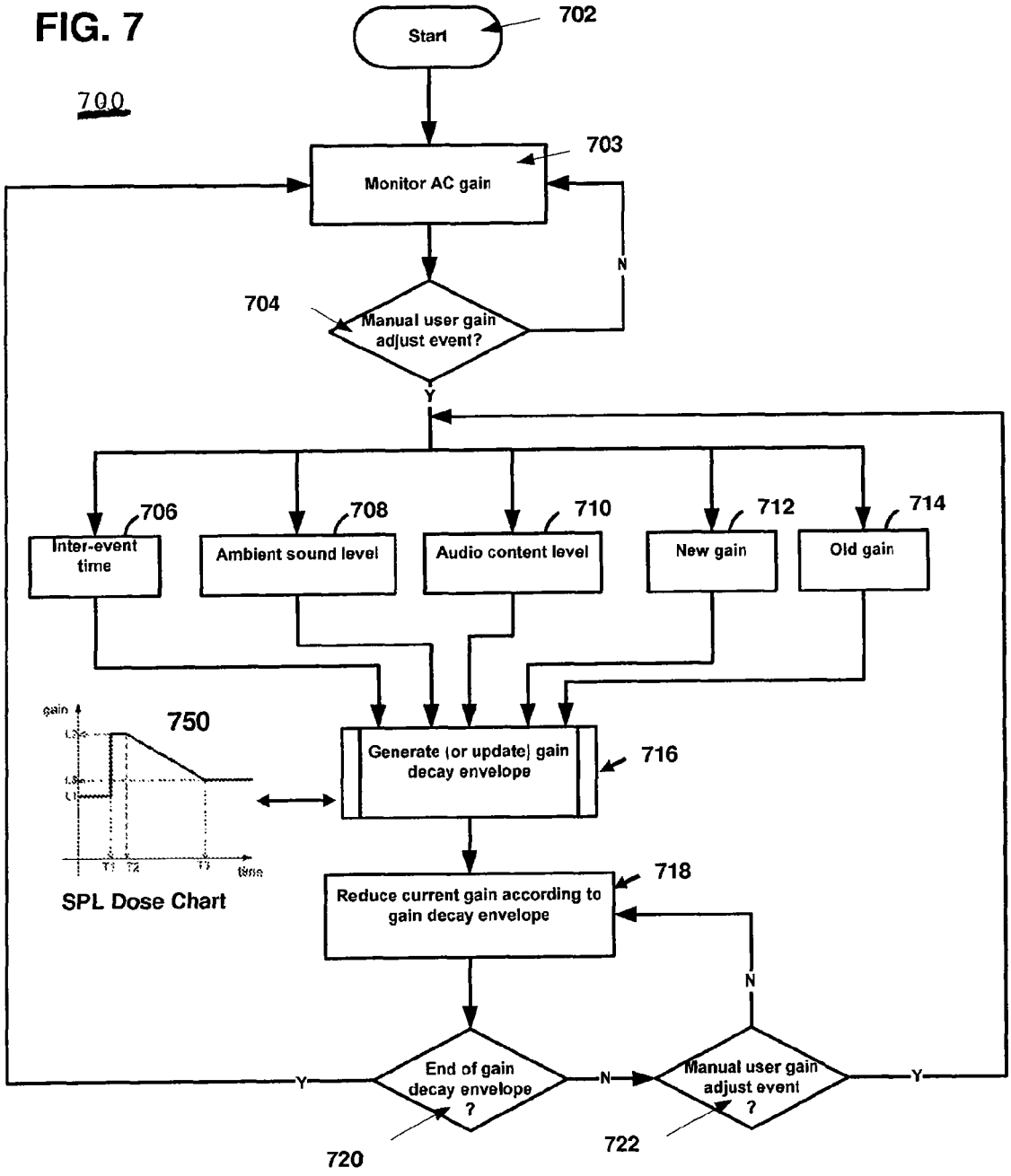
FIG. 7 is a flowchart of a method for automatic gain reduction in accordance with an exemplary embodiment.

FIG. 7 is a flowchart of a method 700 for sound level monitoring and automatic reduction in accordance with an exemplary embodiment. The method 700 can be practiced with more or less than the number of steps shown and is not limited to the order shown. To describe the method 700, reference will be made to the components of FIG. 2, although it is understood that the method 700 can be implemented in any other manner using other suitable components. The method 700 can be implemented in a single earpiece, a pair of earpieces, headphones, or other suitable headset audio delivery device.

The method 700 can start at step 702 in a state wherein the earpiece 100 has been inserted and powered on. It can also start in a state wherein the earpiece 100 has been paired or communicatively coupled with another communication device such as a cell phone or music media player.

At step 703, the earpiece 100 monitors a gain of audio content delivered to the Ear Canal Receiver (ECR). It can do this by reading the current gain setting on the earpiece, receiving a communication from the paired mobile device indicating the volume setting, or analyzing a sound pressure level within the ear-canal. Sounds within the ear canal are due in part to ambient sound, audio content, or the user's spoken voice. The ECM 130 lies within the ear canal and measures these SPL levels produced by the ECR 120. As previously indicated, sound within the ear canal can be generated by audio content delivered to the ECR 120, ambient pass-through from the ASM 110, or spoken voice by the user of the earpiece. In the latter case, sound can be generated in the ear canal when the user speaks due to internal bone conduction. The ECM 130 assess these sound exposure levels in the ear canal which impart on the ear drum; the sounds can include the reproduced content levels (music) as well as residual ambient sound pass-through. Recall, the processor can regulate the pass-through of ambient sounds in the user's environment to the ear-canal by way of the ASM 110 and ECR 120.

At step 704, the earpiece detects manual user gain adjustment events. For instance, upon the user selecting a song, the earpiece 100 can log(record) how often the user adjusts the volume (gain) thereafter. It also records the time intervals between the user adjusted gain changes, gain levels, and associated volume increases with volume changes. Additionally, the earpiece 100 analyzes the digital audio content levels prior to delivery to the ECR 120. Based on the Ear Canal Transfer Function (ECTF), gain settings, and equalization profiles, it estimates a corresponding SPL generated by the ECR 120. The earpiece 100 can also log the degree of sealing of the earpiece as well as the ambient sound levels and pass-through levels. This information can in turn be used to determine a suitable reduction strategy to automatically decrease the volume over time—after a manual user gain adjustment—to safe listening levels without annoying the user and in accordance with the SPL Dose Chart 750.

When at step 704, upon detecting a manual user gain adjustment event, the earpiece 100 stores the information event and refers to the user history profile and SPL Dose Chart 750 to determine how to proceed with automatically adjusting the audio content levels, and possibly ASM 110 pass-through. The earpiece 100 continues to monitor the audio content gain if no manual intervention is detected. If the user increases the volume to a listening level that is considered safe, or safe for the time being, then no action may be taken. If the gain is however elevated to an unsafe level, the earpiece will refer to the SPL Dose chart 750 to determine appropriate gain level reductions (corrections) over time following the gain adjustment. The earpiece 100 can also report if the music listening level is within or exceeds a safe listening level in accordance with SPL Dose measurements. If the user gain adjustment decreases the volume when listening in an unsafe mode, then the earpiece decreases the gain in accordance with the user adjustment and the user's history profile.

In general, the earpiece 100 reduces the audio content responsive to detecting intermittent manual increase gain adjustments of the audio content in accordance with the SPL Dose Chart 750. Intermittent means the user occasionally adjusts the volume, for example, to merely enjoy louder musical passages, or if he or she is not satisfied with the automatic updated gain level. The latter may occur if the automatic gain reduction performed by the earpiece decreases the volume over time more so than the user is willing to accept over that time interval. The earpiece gradually reduces the volume of the audio content over time so as to minimize a change in perceptual loudness associated with the gradual reduction in volume.

As shown, the SPL Dose chart receives as input at least one of an inter-event time 706, an ambient sound level 708, an audio content level 710, a new gain 712, and/or an old gain 714. As shown at step 716, the earpiece 100 then generates (or updates) a gain decay envelope that controls the reproduced audio content level. In particular, the processor 206 maps the input information (or combination of inputs) to a gain level reduction that will be applied to the audio content over time to gradually reduce the volume to a safe listening level. The SPL Dose Chart 750 characterizes the gain as a function of the inter-event time difference (x-axis) and the gain level difference (y-axis).

The inter-event time 706 is the time (e.g. in seconds) between when the user manually adjusts (e.g., increases) the gain of the Audio Content. For example, upon identifying a first event time at which a first manual gain change is detected, identifying a second event time at which a second manual gain change is detected, and calculating a time difference between the first and second event time to produce an inter-event time, the earpiece reduces the magnitude of the audio content as a function of the inter-event time, whereby smaller inter-event times produce smaller changes in the reduction of audio content gain.

The ambient sound level 708 affects the amount by which the gain decay envelope vector decreases over time. For instance, in a transparency mode whereby ambient sounds are passed to the ear canal in full pass-through mode without gain amplification or suppression, the ambient sounds contribute sound pressure to the measured SPL within the ear canal. Thus a stronger gain reduction is required to account for the ambient sounds. In another arrangement, the gain function may not be affected, as the processor 206 can actively decrease pass-through to reduce residual ambient sound levels in the ear canal.

The audio content level 710 is the level of the audio content signal after it has been amplified and before it is reproduced with the ECR 120. In another embodiment, the audio content level (ACL) is the level of the audio content signal before it has been amplified. In one exemplary embodiment, the ACL is calculated using a slow level weighting, as with the ambient sound level, and in one exemplary embodiment the signal is filtered before the ACL is calculated using an A-weighting curve.

The new gain 712 is the most recent manual increase gain adjustment, for example, when the user turns up the volume on the mobile device or earpiece. The new gain 712 may be a gain multiplier value (in decibels or as a linear gain value). In another example, this gain value may be a number corresponding to a permissible "volume" level set by the mobile device, e.g. an integer value from 0 to 10. The old gain 714 is the prior new gain, or in certain cases the gain just prior the new gain, for example, right before the user increases the volume. The former and latter may be different since the earpiece gradually reduces the audio content level over time.

At step 718, the earpiece reduces the current gain (volume) of the audio content according to the gain decay envelope previously calculated from the SPL Dose Chart. Notably, the gain decay is not immediate, but gradually tapers down after the user manually increases the volume. This is to permit the user to first adjust to the elevated manual gain setting before slowly reducing it back down to a safe level. In one configuration, the volume is reduced in increments of a Just Noticeable Difference (JND) as a function of time differences between the intermittent volume gain increases and level differences of the intermittent volume gain increases. Depending on the frequency band the JND may be between 0.5 dB to 1 dB. Taking into account hearing sensitivity due to Temporary Threshold Shifts (TTS) across frequency bands, a 1 dB gain reduction may be staged over a 2-5 minute time interval depending on the frequency band and loudness level to avoid being audibly noticed by the user. Thus in response to the user increasing the gain 3 dB above a safe listening level, the earpiece may gradually reduce the overall volume 1 dB over the next few minutes of listening.

If the user again manually increases the volume during the gradual gain reduction period, the earpiece 100 thereafter applies a lesser gain reduction. The earpiece 100 at step 720 first determines if the gradual gain reduction (envelope decay) is complete prior to the second manual volume increase. If so, the method returns back to step 703 where the earpiece 100 monitors the audio content gain and any manual user volume intervention. This is the case where the earpiece has gradually reduced the volume over time in a manner audibly acceptable to the user. If however, the user manually increases the volume at step 722 whilst the earpiece is in the process of applying the gain reduction envelope (thereby gradually reducing the gain to a safe listening level), the earpiece 100 reassesses the gain decay in view of the requested volume change and the time difference between the manual user intervention based on the SPL Dose Chart 750. The earpiece then updates the gain reduction according to the reassessed gain decay envelope and applies it to the audio content back at step 718. This feedback loop relaxes the gain reduction to accommodate the user's preferred listening level; that is, it backs off on the gain reduction if the user manually increases the gain during the gain reduction period. It can continue to do this based on the frequency interval and level difference of the manually adjusted gain settings.

Figure 8:
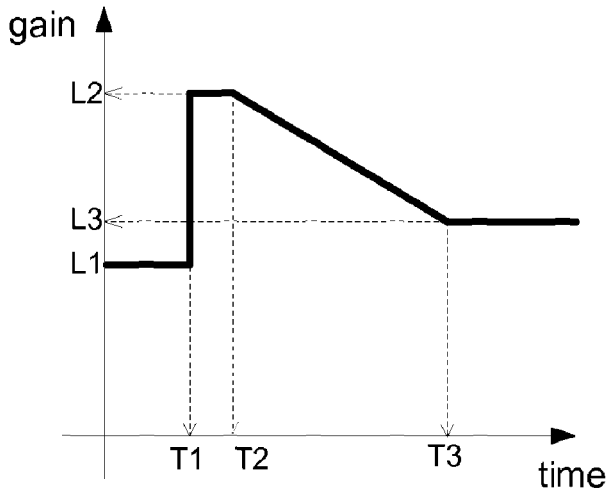
FIGS. 8(*a*), 8(*b*) and 8(*c*) are illustrations depicting gain reduction envelopes employed for automatic gain reduction in accordance with an exemplary embodiment.
Figure 8:
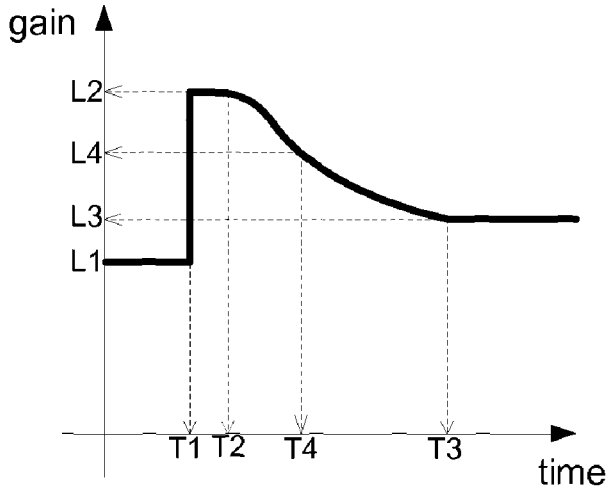
Figure 8:
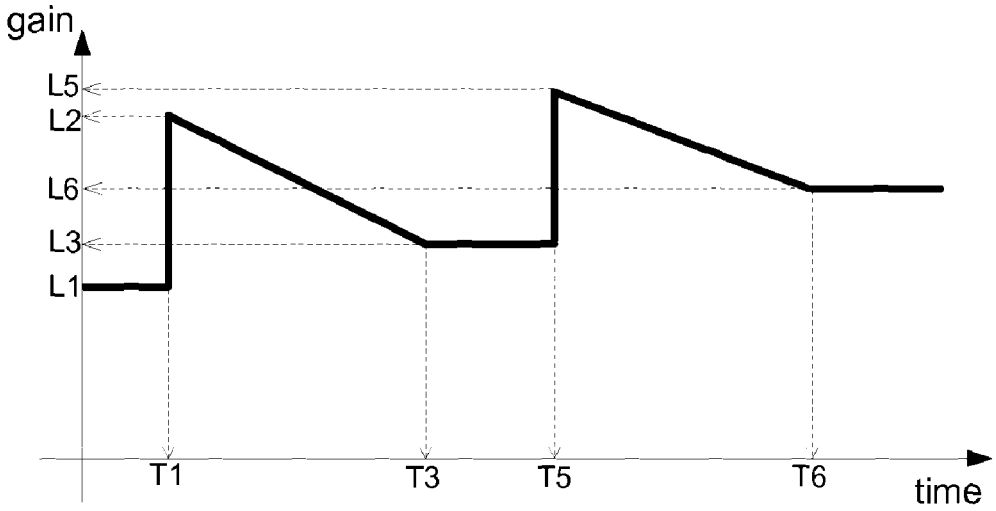

FIGS. 8(*a*), 8(*b*) and 8(*c*) illustrate three exemplary graphs of an SPL Dose Chart for gradually reducing the volume of the audio content. The graphs characterize the gain reduction over time in response to the intermittent gain (volume) increases. The gain reduction attempts to minimize a perceived change in loudness over time based on perceptual criteria (e.g., Temporary Threshold Shifts) as well as learned user information (e.g., how often the user increases the volume, and how much).

As shown in FIG. 8(*a*), the gain reduction corresponds to the solid line plot; this in turn when applied to the audio content is considered the gain decay envelope. The gain reduction at any particular point is a function of the inter-time difference (e.g., T2-T1) on the x-axis and the volume level difference (L2-L1) on the y-axis. For instance, if at time T1 the user manually adjusts the gain from L1 to L2, then a short time later at T2, the earpiece begins to gradually reduce the volume until it settles to a level L3. Notably, the settled volume L3 is above the original L1 level prior to the manual increase, but not as high as the user initially desired. Thus the level is effectively increased as intended by the user but not necessarily to the actual selected level. The decay time from L2 to L1 as well as the time T2 at which the gradual reduction begins is perceptually based; that is, it is a function of the temporary threshold shifts, the 'user's hearing sensitivity, the loudness and the frequency band.

If the Audio Content Level (ACL) increases from the level at the time of the gain change event (i.e. level L1), then the amount by which the gain finally reduces to at time T3 reduces (i.e. the slope or gradient of the gain decay envelope becomes less negative and closer to zero) compared with the case when the change in ACL is substantially equal to zero. It should be noted that the gain of the audio content (AC) signal is not reset to the initial level due to the process of Temporary Threshold Shift (US): whereby the hearing threshold for a given frequency increases over time when sound is continually presented at that frequency. For most frequencies, US is linearly related to the logarithm of the time exposure. Accordingly, the overall reduction of AC gain is approximately halved for a doubling in the time interval over which the gain is reduced (e.g., time T3-T1 in FIG. 8(*a*)). For a sensation level of exposure at 80 dB for 3 minutes (test tones of 1 kHz), the TTS is approximately 2.5 dB. When the sensation level of exposure is 90 dB, the TTS approaches 3 dB. Extrapolated data from these points provides the gain reduction values. The earpiece then modifies the AC level by which the gain is reduced according to the total ACL. For example, the difference between L3 and L1 when L2 gives an ear canal SPL of approximately 80 dB will be less than 3 dB if T3-T1 is approximately 3 minutes.

The values of L2 and L1 can be used to modify the gain decay slope from a straight line, as shown in FIG. 8(*a*), to a curved slope, as shown in FIG. 8(*b*). This modification is motivated by a desire to minimize the perceptual detection of a level change (i.e. reduction) of the Audio Content signal reproduced with the ECR over time. The processor modifies the rate of change of slope such that after an initial time period T2-T1 when the gain is not modified by the ALRS, the gain slope reduces at a rate approximating a decaying exponential, as shown in FIG. 8(*b*). This is to model the auditory systems hearing sensitivity—wherein for wideband or band pass-filtered noise, the smallest detectable intensity change is approximately a constant fraction of the intensity of the sound stimulus—i.e. an example of Weber's law.

In one exemplary embodiment, when the ACL is 80 dB, and the manual gain increase L2-L1 is X dB, the level change L2-L3 is equal to $\lambda/2$ dB over 10 minutes (i.e. T3-T1 is 10 minutes). In another exemplary embodiment, when the manual gain change is such that the new ACL is less than approximately 78 dB, then the ALRS does not automatically reduce the gain (the above examples assume that the change in ACL and ambient noise level do not significantly change over the duration of the automatic gain change).

With respect to FIG. 8(*c*), the inter-event time is equal to the time difference between time T5 and T1. As shown the "inter-event time" is the time between manual adjustments. As the inter-event time decreases, the amount by which the gain of the AC reduces is also reduced. As illustrated the first gain reduction (L2-L3) of the first manual user gain event at time T1 is greater than the second gain reduction (L5-L3) at time T2; that is, (L2-L3)>(L5-L6). Hence as shown in FIG. 8(*c*), the gain reduction following the gain increases at T1 is equal it L2-L3. The level goes-back to a higher level L3, and this level is less than the gain reduction following the gain increase at T5. As indicated previously in FIG. 7, the gain decay envelope takes as its inputs at least one of the following: Inter-event time 706, ambient sound level 708, Audio content level (ACL) 710, new gain 712 and old gain 714. This scenario assumes that there is no significant change in the ambient sound level or further user modification of the ambient pass-through or AC gain. This process is motivated by a desire to minimize the annoyance of the ALRS user.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions of the relevant exemplary embodiments. Thus, the description of the invention is merely exemplary in nature and, thus, variations that do not depart from the gist of the invention are intended to be within the scope of the exemplary embodiments of the present invention. Such variations are not to be regarded as a departure from the spirit and scope of the present invention.

What is claimed is:

1. An earpiece, comprising:

an Ear Canal Receiver (ECR) to deliver audio content to an ear canal; and a processor operatively coupled to the ECR to reduce over time a level of the audio content delivered to the ECR responsive to detecting intermittent manual increase gain adjustments by a user of the earpiece.

2. The earpiece of claim 1, where the processor reduces over time the level of the audio content as a function of time differences between the intermittent manual increase gain adjustments and level differences of the intermittent manual increase gain adjustments.

3. The earpiece of claim 1, further comprising:

an Ear Canal Microphone (ECM) configured to measure a sound pressure level (SPL) within the ear canal, where the processor in view of the SPL adjusts a gain decay envelope of the audio content to a safe listening level according to an SPL Dose chart.

4. The earpiece of claim 3, where the SPL Dose chart receives as input at least one of an inter-event time, an ambient sound level, or an audio content level, and maps the input to a gain level reduction of the audio content.

5. The earpiece of claim 1, further comprising:

an Ambient Sound Microphone (ASM) to capture ambient sound; and a sealing section to partially occlude the ear canal and suppress the ambient sound from entering the ear canal, where the processor regulates a pass-through of the ambient sound through the sealing section to the ear-canal by way of the ECR.

6. The earpiece of claim 5, where the sealing section is a foam ear insert.

7. The earpiece of claim 5, where the sealing section is an inflatable balloon.

8. The earpiece of claim 1, further comprising:

a transceiver to receive and transmit the audio content from a paired communication device.

9. The earpiece of claim 1, further comprising a media player communicatively coupled to the earpiece to deliver or adjust the audio content responsive to each manual increase gain adjustment.

10. A method to automatically adjust listening levels, the method comprising the steps of:

monitoring a level of audio content delivered to an Ear Canal Receiver (ECR) of an earpiece;

monitoring a sound pressure level within an ear-canal, due in part to ambient sound and the audio content; and modifying the audio content responsive to detecting intermittent manual increase gain adjustments of the audio content.

11. The method of claim 10, where the step of modifying the audio content includes reducing a gain of the audio content over time after a manual gain change is detected.

12. The method of claim 10, further comprising:

identifying a first event time at which a first manual gain change is detected;

identifying a second event time at which a second manual gain change is detected;

calculating a time difference between the first event time and the second event time to produce an inter-event time; and reducing a magnitude of the audio content as a function of the inter-event time, where smaller inter-event times produce smaller changes in a reduction of audio content gain.

13. The method of claim 12, further comprising:

identifying a first level difference responsive to the first manual gain change;

identifying a second level difference responsive to the second manual gain change;

calculating a level difference ratio between the first level difference and the second level difference; and reducing the magnitude of the audio content as a function of the inter-event time and the level difference ratio.

14. The method of claim 10, further comprising:

detecting a sound pressure level (SPL) change in an ambient environment by way of an Ambient Sound Microphone (ASM); and adjusting a pass-through of the ambient sound through a sealing section of the earpiece to the ear-canal by way of the ECR to maintain a constant ratio of an audio content SPL and a residual ambient sound SPL in the ear-canal.

15. The method of claim 14, further comprising:

reducing the pass-through of the ambient sound to the ear-canal responsive to detecting the intermittent manual increase gain adjustments so as to perceptually enhance an audio content loudness relative to the ambient sound.

16. The method of claim 10, further comprising:

using a first slow weighted average of a sound pressure level (SPL) measured within the ear-canal and a second slow weighted average of an ambient sound SPL to produce a gain decay envelope with which to modify the audio content.

17. The method of claim 10, further comprising:

measuring an ambient sound level by way of an Ambient Sound Microphone (ASM); and estimating a residual ambient sound level in the ear-canal by compensating the ambient sound level for a noise reduction rating of the earpiece.

18. The method of claim 10, further comprising:

estimating a sound pressure level (SPL) of the audio content within the ear-canal by applying an Ear Canal Transfer Function (ECTF) to the audio content delivered to the ECR; and estimating a residual ambient sound level in the ear-canal by subtracting the estimated SPL of the audio content from a measured SPL within the ear-canal.

19. A method for perceptual reduction of audio content volume, the method suitable for use in a mobile device or an earpiece and comprising the steps of:

monitoring a music listening level within an ear canal;

reporting if the music listening level is within or exceeds a safe listening level;

monitoring volume gain increases by a user of the mobile device or the earpiece;

gradually reducing the audio content volume over time responsive to intermittent volume gain increases so as to minimize a change in perceptual loudness associated with the gradual reducing of the audio content volume.

20. The method of claim 19, where the audio content volume is reduced in increments of a Just Noticeable Difference (JND) as a function of time differences between the intermittent volume gain increases and level differences of the intermittent volume gain increases.

21. The method of claim 19, further comprising:

estimating a first gain difference associated with a first user gain increase;

identifying a time difference between the first user gain increase and a second user gain increase;

estimating a second gain difference associated with the second user gain increase; and reducing the audio content volume as a function of the time difference and a ratio of the first gain difference to the second gain difference.

* * * * *